US006279286B1

(12) United States Patent
Ichihashi

(10) Patent No.: US 6,279,286 B1
(45) Date of Patent: Aug. 28, 2001

(54) FASTENING MEMBER FOR VERTICAL BOARD SIDING, VERTICAL BOARD SIDING USING THE FASTENING MEMBER, AND VERTICAL SIDING STRUCTURE CONSTRUCTED USING THE FASTENING MEMBER

(75) Inventor: Mamoru Ichihashi, Osaka (JP)

(73) Assignee: Nichiha Corp., Aichi (JP)

( * ) Notice: Subject to any disclaimer, the term of this patent is extended or adjusted under 35 U.S.C. 154(b) by 0 days.

(21) Appl. No.: 09/362,095

(22) Filed: Jul. 28, 1999

(51) Int. Cl.[7] ..... E04B 2/30; A47B 96/06
(52) U.S. Cl. ..... 52/489.1; 52/715; 248/218.4
(58) Field of Search ..... 248/218.4, 219.1, 248/300, 200; 52/489.1, 489.2, 712, 715, 387, 391

(56) References Cited

U.S. PATENT DOCUMENTS 2,851,740 * 9/1958 Baker ..... 52/489.2 X
3,020,602 * 2/1962 Siering ..... 52/489.2 X
4,621,473 * 11/1986 Wendt ..... 52/489.2
5,390,457 * 2/1995 Sjolander ..... 52/387
5,493,831 * 2/1996 Jansson ..... 52/489.1 X

* cited by examiner

*Primary Examiner*—Daniel P. Stodola
*Assistant Examiner*—Hugh B. Thompson
(74) *Attorney, Agent, or Firm*—Lowe Hauptman Gilman & Berner, LLP

(57) ABSTRACT

A fastening member for the vertical board sidings, which comprises a flat substrate; first and second upright portions formed at the upper and lower end portions of the flat substrate, respectively and extending in the horizontal direction; a third upright portion formed along a longitudinal direction of the flat substrate; a locking portion formed along a distal end of the third upright portion; and a slot formed in the substrate and extending laterally from one side to the other of the substrate; wherein the siding boards are adapted to be fastened between distal ends of the first and second upright portions and the locking portion formed along a distal end of the third upright portion.

8 Claims, 12 Drawing Sheets

FASTENING MEMBER FOR VERTICAL BOARD SIDING, VERTICAL BOARD SIDING USING THE FASTENING MEMBER, AND VERTICAL SIDING STRUCTURE CONSTRUCTED USING THE FASTENING MEMBER

BACKGROUND OF THE INVENTION

This invention relates to a fastening member for mounting vertical board siding to a building frame, in which ceramic siding boards are attached to a building frame with the longitudinal direction of each ceramic siding board being orientated in the vertical direction. This invention also relates to a method of installing vertical board siding using the fastening member, and to a vertical board siding structure constructed using the fastening member.

The board siding using a ceramic siding board has been executed either by a horizontal board siding where the siding board is attached to the framework of a building with the longitudinal direction of the ceramic siding board being directed in the lateral direction (horizontal direction), or by a vertical board siding where the siding board is attached to the framework of building with the longitudinal direction of the ceramic siding board being directed in the upright direction (vertical direction).

According to the horizontal board siding, as shown in FIG. 12, a moisture permeable waterproofing sheet (or an asphalt saturated felt) 3 is first attached to a framework consisting of posts 1 and studs 2, and then, in conformity with the longitudinal directions of the posts 1 and studs 2, vertical furring strips 4 are attached to the posts 1 and studs 2 with the moisture permeable waterproofing sheet 3 being interposed therebetween. Thereafter, external wall panels (siding boards) (not shown) are fastened to the vertical furring strips 4, thereby forming a ventilation layer between the moisture permeable waterproofing sheet 3 and the siding boards.

The jointing in the vertical direction of the siding boards has been performed either by a method wherein a rabbeted edge portion of a siding board is directly fitted in or engaged with a corresponding rabbeted edge portion of another siding board, and then the siding boards are nailed and fixed to the vertical furring strips 4, or by a method wherein instead of the aforementioned engagement between the rabbeted edge portions of the siding boards, a shiplap joint portion of the siding board is fully engaged with a dedicated fastening member, which is then fixed to the vertical furring strips 4 with of a nail (or a screw) Since the horizontal board siding employing the aforementioned fastening member is advantageous not only in fastening strength and durability but also in simplicity of executing method, the horizontal board siding is now increasingly employed.

On the other hand, with the vertical board siding, as shown in FIG. 13, a moisture permeable waterproofing sheet (or an asphalt saturated felt) 3 is first attached to a framework consisting of posts 1 and studs 2, and then, horizontal furring strips 5 extending across the posts 1 and studs 2 are horizontally attached to the posts 1 and studs 2 with the moisture permeable waterproofing sheet 3 being interposed therebetween, thereby fastening several lines of horizontal furring strips 5 spaced in vertical direction from each other by a predetermined distance. Thereafter, external wall panels (siding boards) (not shown) are fastened to the horizontal furring strips 5. In this case, a space "s" is provided between the horizontally neighboring horizontal furring strips 5, thereby securing a ventilation passage.

As seen from FIG. 14 showing the horizontal cross-sectional view of a fastening state in this board siding and from FIG. 15 showing the front wall surface of the resultant siding structure, the horizontal jointing between the neighboring siding boards 10 is effected by the engagement between the rabbeted edge portions of the siding boards 10, while the vertical jointing between the vertically neighboring siding boards 10 is effected by making use of a draining metal fitting 6. Further, the fastening of the siding boards has been conventionally performed by means of nailing work using a nail or a screw 11.

As described above, with the vertical board siding, the horizontal jointing between the neighboring siding boards is effected by the engagement between the rabbeted edge portions of the siding boards, the vertical jointing between the vertically neighboring siding boards is effected by making use of a draining metal fitting, and the fastening of the siding boards is performed by means of nailing work. Therefore, in spite of the advantage that a joint sealing work which is required in the horizontal board siding is not required in the case of the vertical board siding, a large number of relatively short horizontal furring strips are required to be fastened as a backing framework as shown in FIG. 13, which necessitates a longer construction period as well as increased material cost. Further, the position of the external wall surface of the building is caused to protrude externally by a distance corresponding to the thickness of the furring strip 5.

Additionally, since the nailing in this case is performed in such a manner that each siding board 10 is individually fixed to the furring strips using a nail 11, the jointing between the horizontally adjacent siding boards is not necessarily sufficient enough. In particular, since the siding boards are vertically fastened, the wind pressure resistive force of the siding boards thus fastened may not be sufficient, if the board siding has not been executed properly according to the prescribed specification for the board siding. Moreover, since the remedy for the head portion of the nail 11 is required after the board siding, nailing is problematic in terms of aesthetic look.

BRIEF SUMMARY OF THE INVENTION

The object of this invention is to solve the aforementioned problems accompanied with conventional vertical board siding. In particular, an object of the present invention is to provide a method of vertical board sidings applying to a building frame, which enables the board siding to be performed easily and within a shortened period of time, and fastening of the siding boards to be performed with a sufficient strength to withstand any wind pressure, and which enables to secure a larger room space as compared with the conventional board siding.

Another object of the present invention is to provide a fastening member which is useful for the aforementioned vertical board siding.

Still another object of the present invention is to provide a vertical board siding structure constructed using the aforementioned fastening member.

With a view to realize the aforementioned objects, this invention provides a fastening member for the vertical board sidings, which comprises;

- a flat substrate constituting a mounting surface to a building frame;
- a first upright portion formed at an upper end portion of said flat substrate and extending in the horizontal direction;

a second upright portion formed at a lower end portion of said flat substrate and extending in the horizontal direction;

a third upright portion formed along a longitudinal direction of said flat substrate;

a locking portion formed along a distal end of said third upright portion; and a slot formed in said substrate and extending laterally from one side to the other side of said substrate;

wherein said siding board is adapted to be fastened between distal ends of said first and second upright portions and said locking portion formed along a distal end of said third upright portion.

According to a preferable embodiment of this invention, the third upright portion is provided with a cutout facing said slot for a convenience of a clamping tool to be employed in attaching the fastening member to a building frame.

This invention further provides a method of installing vertical board siding by making use of the aforementioned fastening member, which comprises the steps of:

attaching a plurality of fastening members to one of posts along the longitudinal direction of the post;

provisionally attaching a plurality of fastening members to another one of posts along the longitudinal direction of the post by insufficiently inserting a clamping member via said slot into said another one of posts thereby allowing said fastening member to be moved in a lateral direction;

vertically placing the siding board between said fastening member that is attached to said one of posts and said fastening member that is provisionally attached to said another one of posts;

moving in the lateral direction said fastening member that is provisionally attached to said another one of posts thereby to press said third upright portion thereof onto a vertical side of said siding board, thus positioning said siding board;

sufficiently inserting said clamping member into said post thereby tightening said fastening member to said post; and repeating the aforementioned steps thereby accomplishing said board siding.

According to the aforementioned method of installing board siding, the preparation for the fastening of siding boards can be accomplished by simply attaching a required number of the fastening members along the longitudinal direction of posts erected neighboring to each other, and, after the siding board is vertically placed between the attached fastening members, the fastening member that has been provisionally attached is moved laterally thereby positioning the siding board and then the fastening member is finally clamped to the post. As a result, a precise positioning and fixing of the siding board can be concurrently accomplished. Further, a ventilation passage can be also secured by the height of the first and second upright portions formed on the fastening member.

Therefore, it is no longer required to attach a plurality of the horizontal furring strips across the posts as required in the conventional vertical board siding (the same in the case of two-by-four construction), and the nailing work can be also omitted. As a result, the fastening work can be greatly simplified, resulting in a prominent shortening of construction period and in a decrease in construction cost. Furthermore, since nailing is no longer required, the aesthetic feeling of the resultant structure can be enhanced. Moreover, since the siding board is fastened in such a way that the vertical sides of siding board are clamped at a plurality of locations, the wind pressure resistive strength can be prominently enhanced as compared with the case where the siding board is fastened by means of nailing work.

Additionally, since the ventilation passage between the building frame and the siding boards is secured by the height of the first and second upright portions formed on the fastening member as mentioned above, and since these upright portions are provided simply for the purpose of securing the ventilation passage, the height of these upright portions is simply required to be the minimum required. As a result, it is now possible to decrease the interval between the back surface of the siding board and the building frame as compared with the conventional board siding using horizontal furring strips where the ventilation passage is secured by providing a space between the neighboring horizontal furring strips.

This invention also provides a vertical siding structure constructed using the aforementioned fastening member, which is characterized in that a required number of the fastening members are attached to each of neighboring posts and along the longitudinal direction of the posts, and that both vertical sides of the siding board are engaged with the locking strips formed along the distal end of the third upright portions of these fastening members.

The "post" set forth in this specification includes all kinds of posts extending vertically in the framework of the building frame such as a column, a stud, a stand pipe, a backing member in the two-by-four construction, etc.

DETAILED DESCRIPTION OF THE INVENTION

Figure 1:
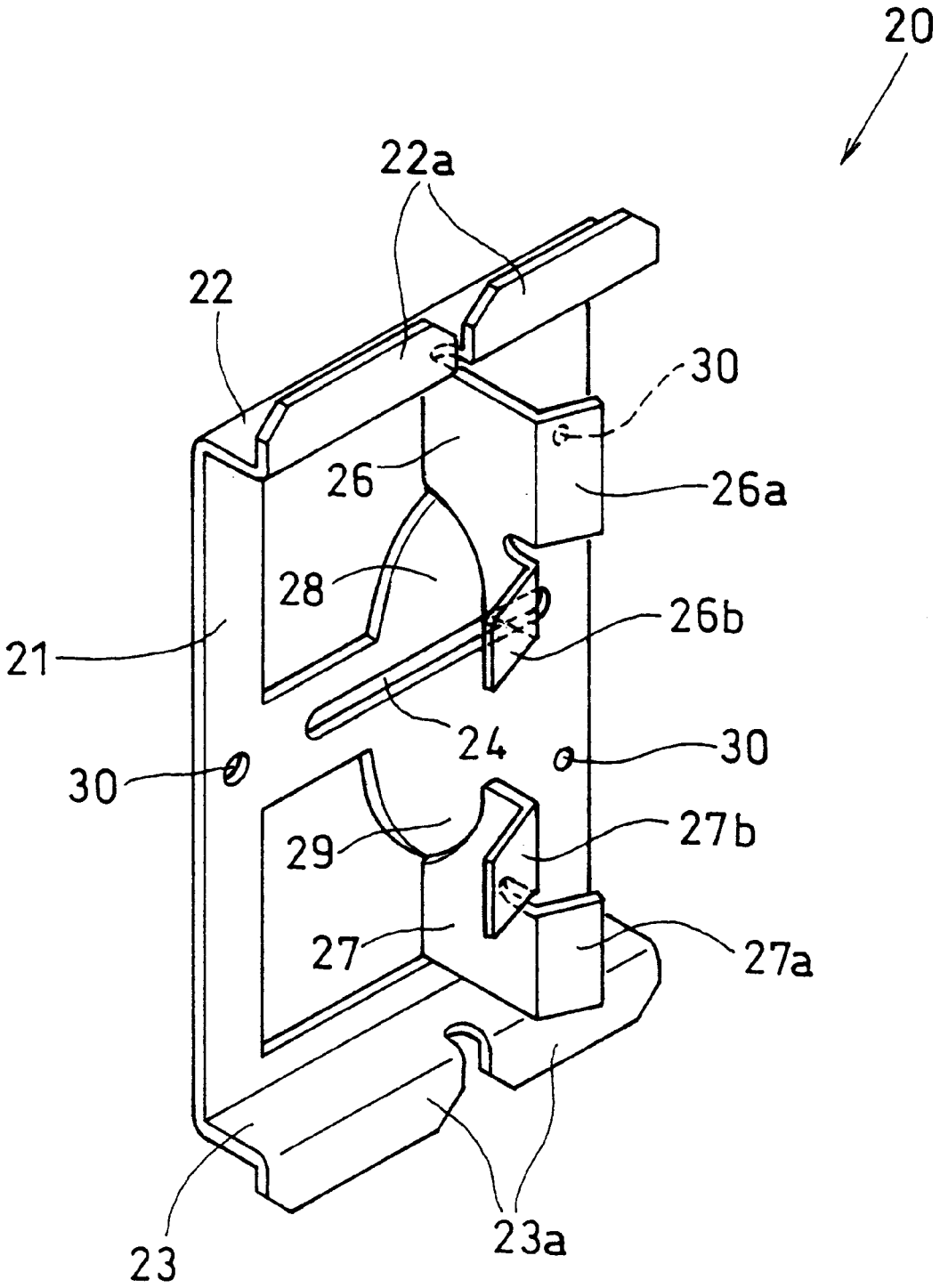
FIG. 1 is a perspective view of a fastening member for vertical board siding representing one embodiment of this invention.
Figure 2A:
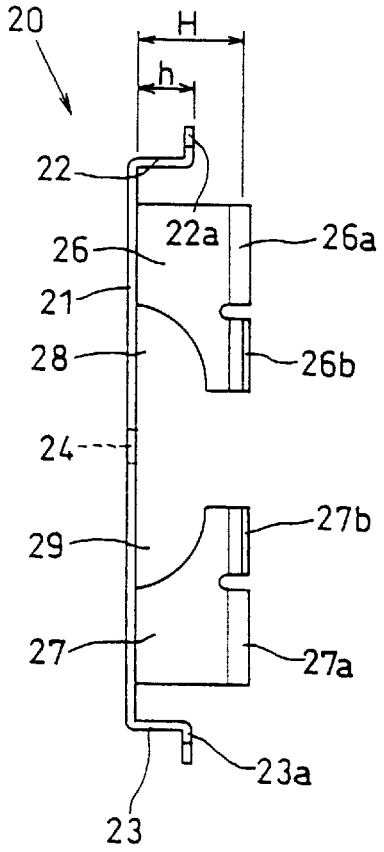
FIG. 2*a* is a side view of the fastening member shown in FIG. 1.
Figure 2B:
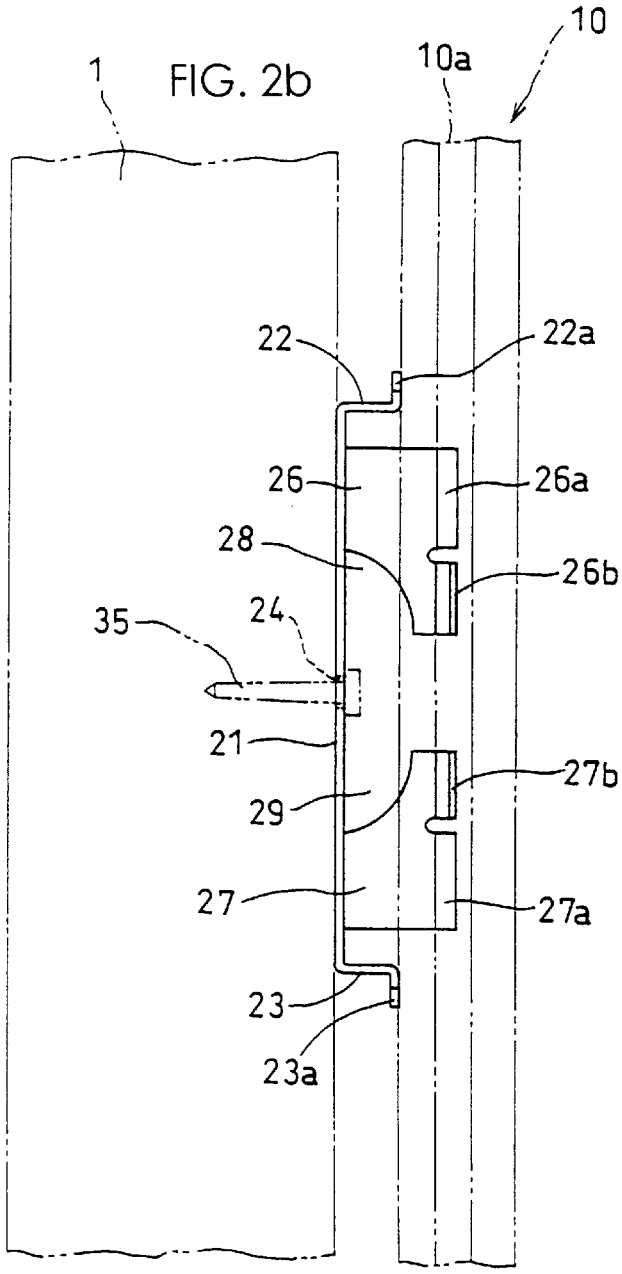
FIG. 2*b* is a side view of the fastening member which is attached to a post.

Preferable embodiments of this invention will be explained in detail below with reference to the drawings. FIG. 1 is a perspective view of a fastening member for vertical board siding representing one embodiment of this invention. FIG. 2 illustrates a side view thereof.

In this embodiment, the fastening member 20 is manufactured by subjecting stainless steel to punching and then to sheet metal working. Specifically, this fastening member 20 comprises a flat substrate 21 constituting a surface for attaching the fastening member 20 to a building frame, i.e. a framework including posts and studs, a first upright portion 22 which has been formed by bending the upper end portion of the substrate 21 by an angle of approximately 90° thereby rendering the bent portion to extend horizontally, the tip end portion of the first upright portion 22 being further bent upward by an angle of 90° thereby to form a vertical plane 22*a* which is parallel with the substrate 21, and a second upright portion 23 which has been formed by bending the lower end portion of the substrate 21 by an angle of approximately 90° thereby rendering the bent portion to extend horizontally, the tip end portion of the second upright portion 23 being further bent downward by an angle of 90° thereby to form a vertical plane 23*a* which is parallel with the substrate 21. The first upright portion set forth in this specification is constituted by this first upright portion 22 and the vertical plane 22*a*, while the second upright portion set forth in this specification is constituted by this second upright portion 23 and the vertical plane 23*a*.

The substrate 21 is provided at approximately the middle portion thereof (as measured in the vertical direction) with a slot 24 extending transversely (horizontally) from one side to the other side thereof. A portion of the substrate 21 located between the slot 24 and the first upright portion 22 is cut and erected perpendicular to the first upright portion 22 thereby forming an upper third upright portion 26. Likewise, a portion of the substrate 21 located between the slot 24 and the second upright portion 23 is cut and erected perpendicular to the second upright portion 23 thereby forming a lower third upright portion 27. As shown in the side view of FIG. 2(*a*) and FIG. 2(*b*) illustrating an attached state of the fastening member, the height "H" of each upper third upright portion 26 and lower third upright portion 27 is set higher than the height "h" of the first and second upright portions 22 and 23, the difference between them (H-h) corresponding to the thickness of the tip ends of the rabbeted edge portion 10*a* of a siding board 10 to be fastened (see FIGS. 7 and 8).

A pair of locking strips 26*a* and 26*b*, each being bent in opposite lateral directions to each other, are formed along the top brim portion of the upper third upright portion 26. Likewise, a pair of locking strips 27*a* and 27*b*, each being bent in the opposite lateral directions to each other, are formed along the top brim portion of the lower third upright portion 27. Further, one side edge portion of the upper third upright portion 26 which faces the slot 24 is cut out to form a cutout portion 28. Likewise, one side edge portion of the lower third upright portion 27 which faces the slot 24 is cut out to form a cutout portion 29. Furthermore, through-holes 30 are formed on both peripheral side portions of the substrate 21.

Next, a specific manner of employing the fastening member 20 for installing vertical board siding of the siding boards will be explained.

Figure 3A:
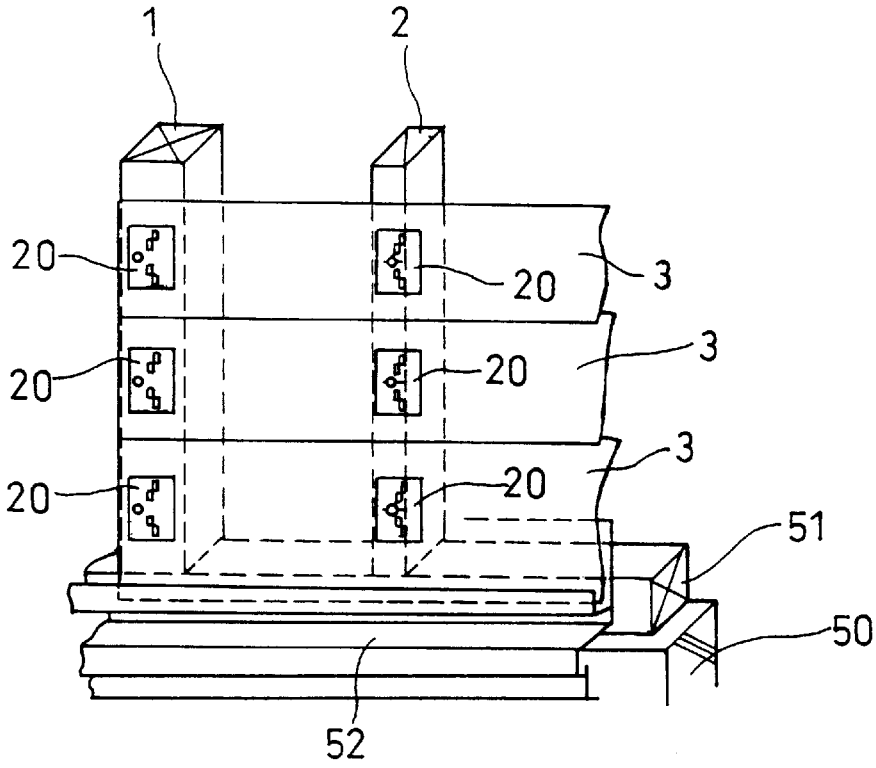
FIG. 3 illustrates an initial procedure in the vertical board siding employing the fastening member shown in FIG. 1.
Figure 3B:
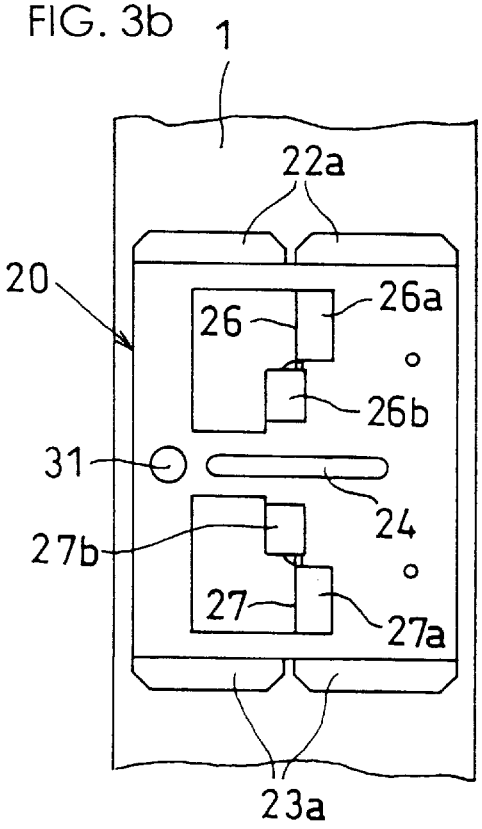
Figure 3C:
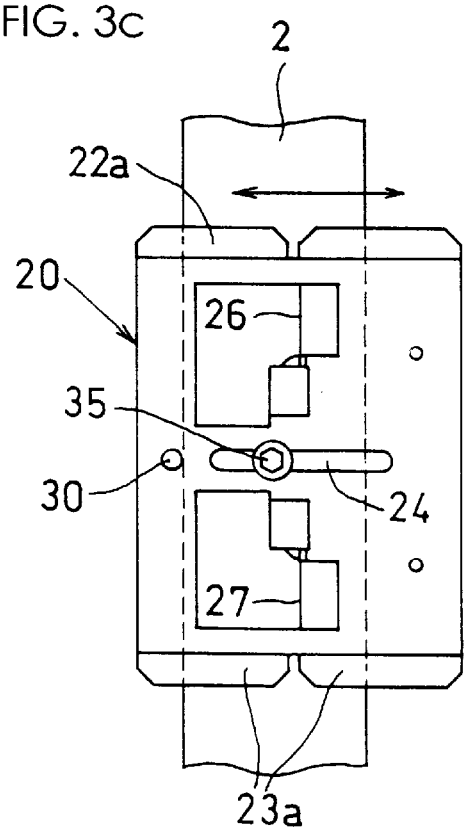

First of all, as shown in FIG. 3(*a*), a moisture permeable waterproofing sheet (or an asphalt saturated felt) 3 is attached to a building frame, i.e. the framework consisting of posts 1 and studs 2 in the same manner as the conventional board siding. In FIG. 3(*a*), the reference numeral 50 denotes a foundation, and 51 denotes a base mounted on the foundation 50. A draining metal fitting 52 is fastened along the base 51. The arrangements of these base 51 and draining metal fitting 52 are the same as the conventional board siding.

In this explanation, the post 1 is assumed to be positioned at the left-most side of the framework, and a first piece of siding board 10 is to be fastened at the position between the post 1 and an adjacent stud 2. At first, a plurality of fastening members 20 are fixed to the post 1 in such a manner that the upper and lower third upright portions 26 and 27 are respectively positioned at the center of the post 1 and are aligned along the longitudinal direction of the post 1, the fastening members 20 are spaced from each other by a predetermined distance (see FIG. 3(*b*)). The fastening members 20 are fixed using a nail 31 inserted through the through-holes 30 formed in the substrate 21.

Then, a plurality of fastening members 20 are fixed to the stud 2 in the same manner as mentioned above. In this case, the fixing of these fastening members 20 is performed in such a manner that the central portion of the slot 24 of each fastening member 20 is positioned at a portion of the stud 2 where one vertical side (a rabbeted edge portion 10*a*') of the siding board 10 which has the other opposite vertical side (a rabbeted edge portion 10*a*) to be contacted with the aforementioned third upright portions 26 and 27 of the fastening member 20 attached in advance to the post 1 would be positioned (see also FIG. 4). After being positioned in this manner, the fastening member 20 is provisionally fixed to the stud 2 by inserting a locking screw 35 into the slot 24 (FIG. 2(*c*)). As a result, the fastening member 20 is kept in place while being allowed to move in the lateral direction.

Figure 4:
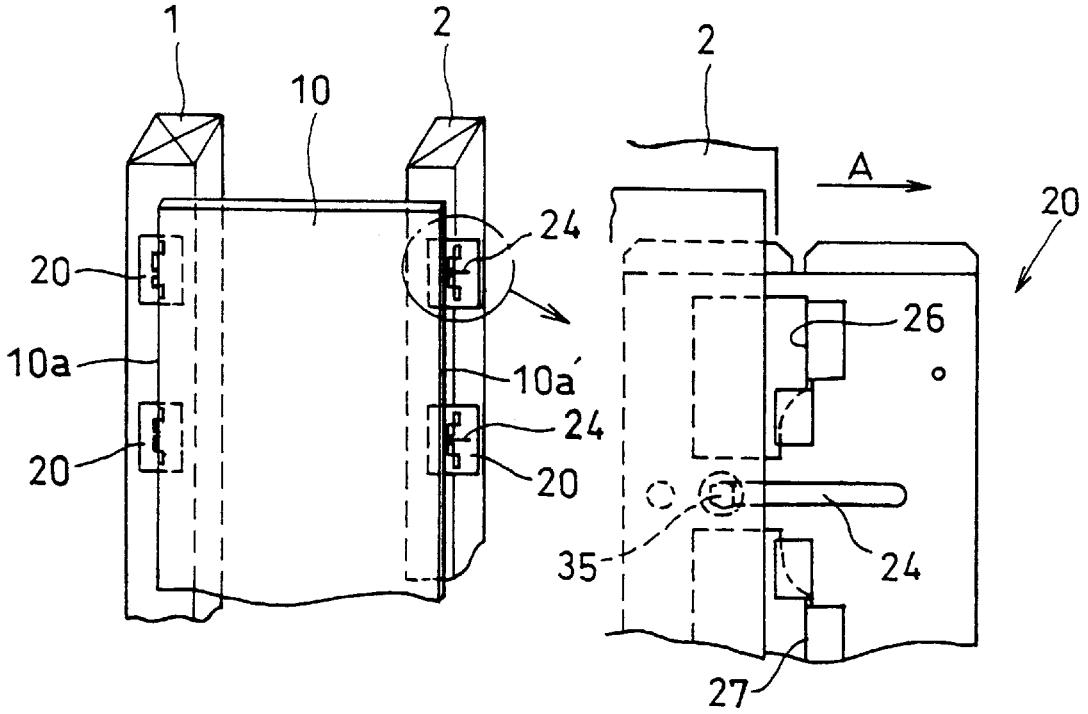
FIG. 4 illustrates a following procedure in the vertical board siding employing the fastening member shown in FIG. 1.

Then, as shown in FIG. 4, the fastening member 20 that has been provisionally fixed to the stud 2 is shifted in the direction indicated by the arrow "A" to place the fastening member 20 on the right-most side. Thereafter, the siding board 10 is vertically positioned between the post 1 and the stud 2, and one vertical side 10*a* of the siding board 10 is placed in contact with the third upright portions 26 and 27 of the fastening member 20 that has been fixed to the post 1. In this case, as shown in FIG. 2, the siding board 10 is supported by the fastening member 20 in such a manner that the back surface thereof is placed on the vertical plane 22*a* of the first upright portion 22 as well as on the vertical plane 23*a* of the second upright portion 23, and that the rabbeted edge portion 10*a* of the vertical side is introduced below the locking strips 26*a* and 27*a* formed respectively on the upper edge portions of the third upright portions 26 and 27 and extending to one side therefrom. As a result, one of the vertical sides 10*a* of the siding board 10 can be firmly retained by the locking strips 26*a* and 27*a* with the front surface of the siding board 10 facing forward. At this moment, the other vertical side 10*a*' (the vertical side positioned on the stud 2) has not been fixed yet even though the back surface of the sliding board 10 is placed on the vertical planes 22*a* and 23*a* of the fastening member 20 attached to the stud 2.

Figure 5:
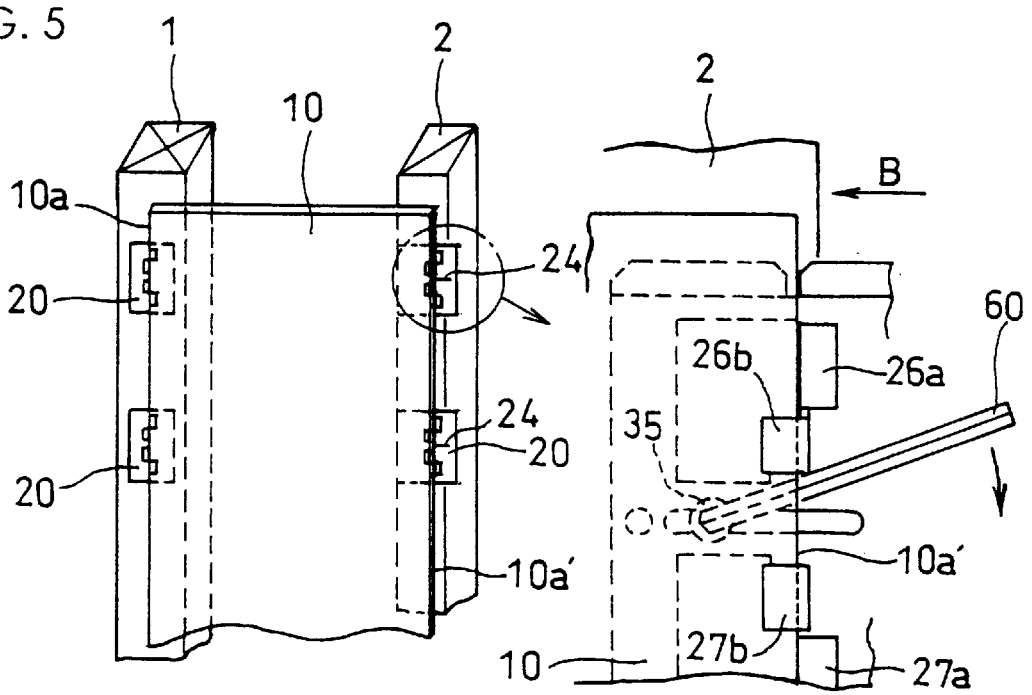
FIG. 5 illustrates a further following procedure in the vertical board siding employing the fastening member shown in FIG. 1.
Figure 6:
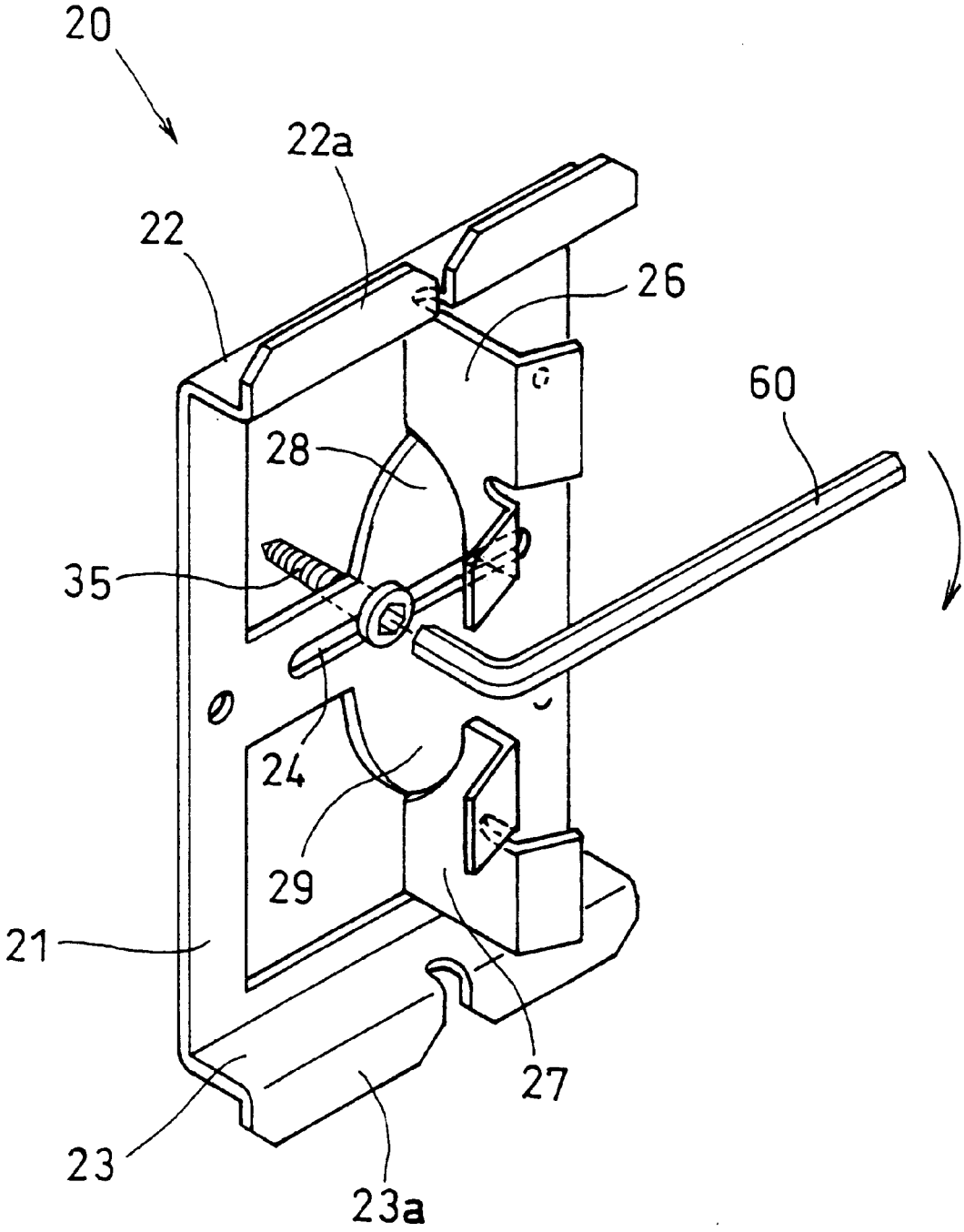
FIG. 6 is a perspective view illustrating a clamping tool to be employed for the final clamping of the fastening member and the manner of employing the clamping tool.

Then, as shown in FIG. 5, the fastening member 20 attached to the stud 2 is shifted leftward (in the direction indicated by the arrow "B"), thereby the rabbeted edge portion 10*a* of the vertical side is introduced below the locking strips 26*b* and 27*b* formed respectively on the upper edge portions of the third upright portions 26 and 27 and extending to the other side therefrom. As a result, the other one of the vertical sides 10*a*' of the siding board 10 can be firmly retained by the locking strips 26*b* and 27*b* with the front surface of the siding board 10 facing forward.

Under this condition, by taking advantage of the cutouts 28 and 29 formed respectively in the upper and lower third upright portions 26 and 27, the distal end of an L-shaped wrench 60 is engaged with the head of the screw 35 that has been provisionally inserted into the stud 2 and rotated so as to firmly fix the screw 35. As a result, the vertical side of fastening member 20 that is positioned on the stud 2 can be also firmly fastened to the stud 2, thus accomplishing the fastening work of the siding board 10.

Then, a second siding board 10 is fixed to the stud 2 by fastening one vertical side 10*a* thereof to the fastening member 20 that has been attached to the stud 2. Thereafter, the fixing of the other vertical side 10*a*' of the siding board 10 to a post or an adjacent stud is repeated in the same manner as explained above, thereby a vertical siding structure of a building frame is constructed using the siding boards 10 where the both vertical sides of the siding board 10 are fastened by means of the fastening members 20 which have been attached in advance to the posts erected adjacent to each other.

With the vertical board siding of this invention, the preparation for the fastening of siding boards can be accomplished by simply attaching a required number of the fastening members along the longitudinal direction of a post 1 and an stud 2 or studs 2 erected adjacent to each other. After the siding board 10 is vertically placed between the attached fastening members 20, the fastening member 20 that has been provisionally attached is moved laterally thereby positioning the siding board in place and then, by a further clamping of the locking screw 35, the fastening member can be finally clamped to the post. As a result, a precise positioning and fixing of the siding board can be concurrently accomplished. Further, a ventilation passage can be also secured by the height of the first and second upright portions 22 and 23 formed on the fastening member 20.

Therefore, with the vertical board siding of this invention, it is no longer required to attach a large number of the horizontal furring strips 5 across the posts as required with the conventional vertical board siding, and the nailing work can be also omitted. As a result, the fastening work can be greatly simplified, the remedy for the head portion of the nail is no longer required, and the aesthetic look of the resultant structure can be enhanced. Moreover, since the siding board is fastened in such a way that the vertical sides of siding board are clamped at a plurality of locations, the wind pressure resistive strength can be prominently enhanced as compared with the case where the siding board is fastened by means of nailing work.

Additionally, since the first and second upright portions 22 and 23 are provided simply for the purpose of securing the ventilation passage, the height of these upright portions is required to be the minimum required. As a result, it is now possible to decrease the interval between the back surface of the siding board 10 and the building frame as compared with the conventional board siding using horizontal furring strips 5 where the ventilation passage is secured by providing a space "s" between the adjacent horizontal furring strips 5, thereby making it possible to secure an increased room space.

Figure 7:
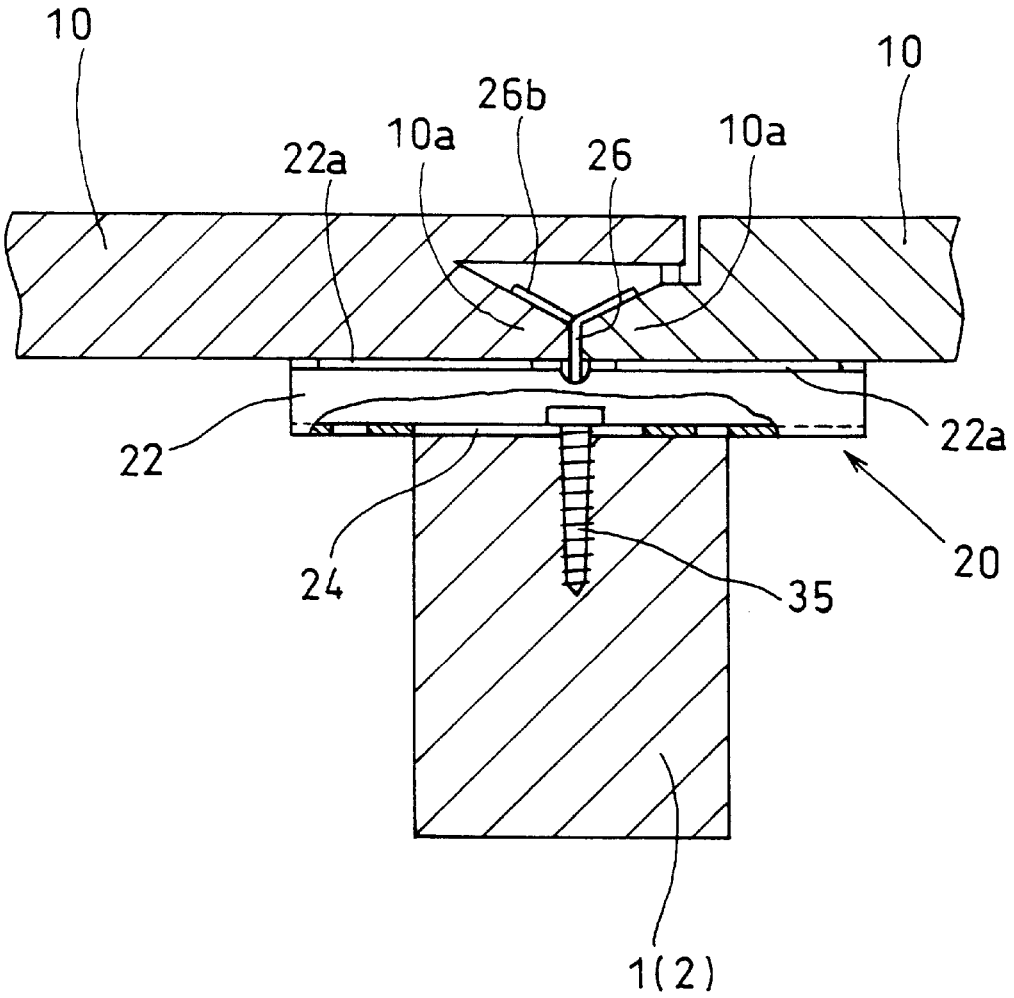
FIG. 7 is a partial cross-sectional view illustrating a state where a siding board is vertically fastened according to one embodiment of this invention.
Figure 8:
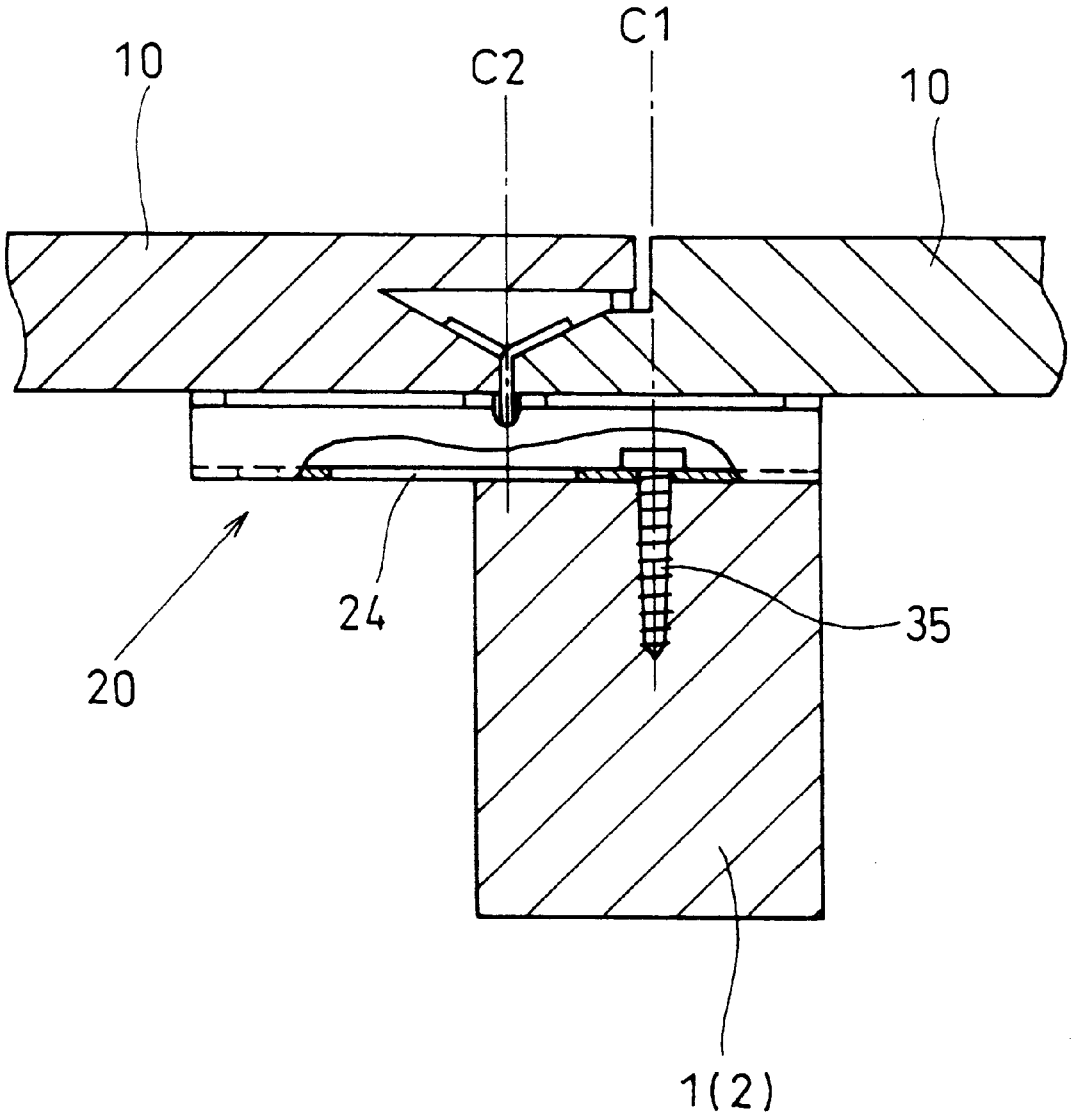
FIG. 8 is a partial cross-sectional view illustrating a state where a siding board is vertically fastened according to another embodiment of this invention.
Figure 9:
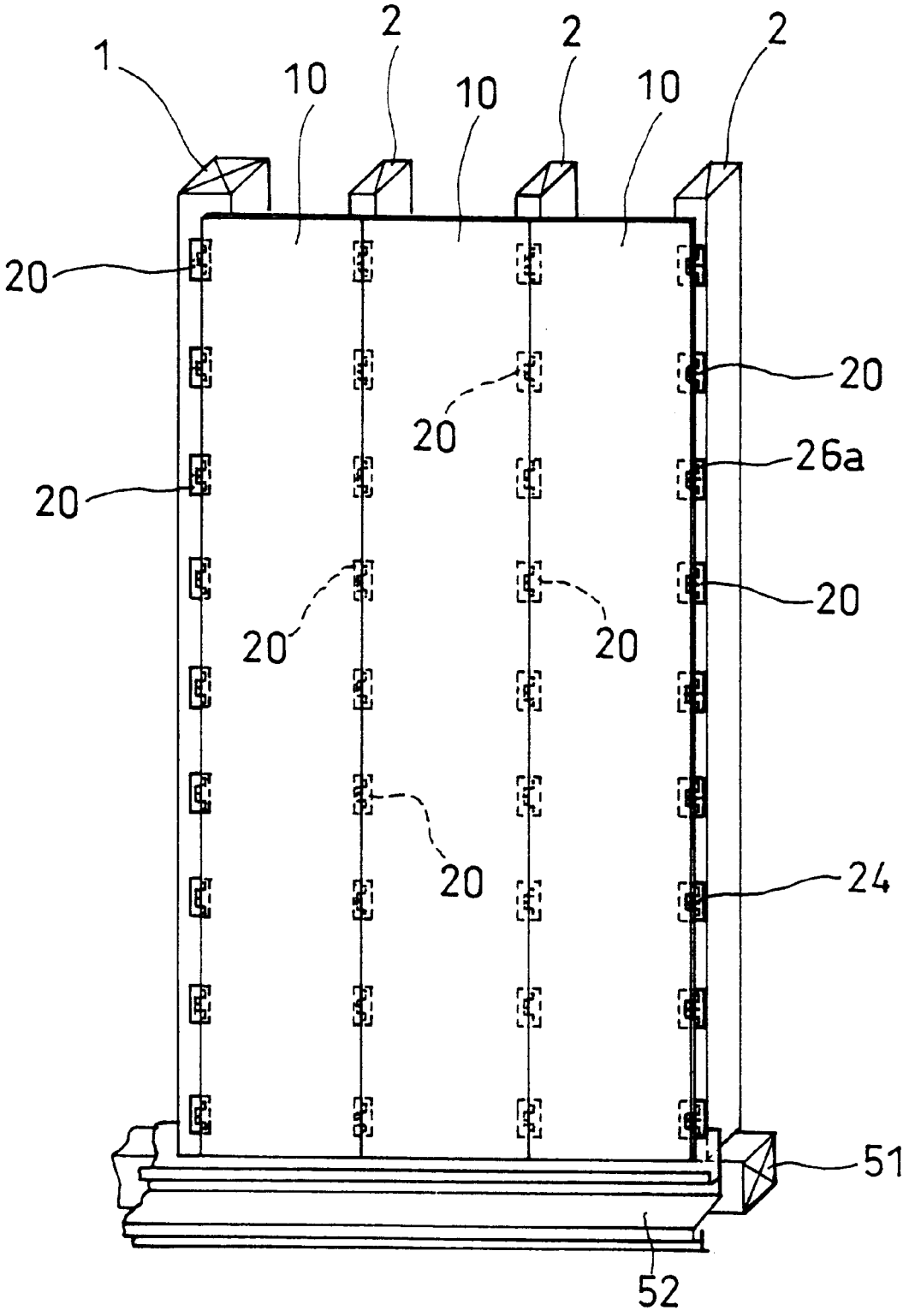
FIG. 9 is a front view illustrating a state where a siding board is vertically fastened according to this invention.

If the lateral width of the siding board 10 is equal to the interval between the posts throughout the entire framework in installing the vertical board siding of this invention, the fastening member 20 can be attached to the posts by aligning the longitudinal axial line of the fastening member 20 with the longitudinal axial line of each post 1 (2), as indicated in FIG. 7 which shows a partially sectioned of the attached structure, thus allowing the siding boards 10 to be simply fastened to the fastening member 20. However, due to inaccuracy of fittings, a slight error is very likely to may be generated in an interval between the posts in the actual construction site. Even if such a situation happens, it is still possible, according to the fastening member 20 of this invention, to fasten the siding board 10 while assuring an excellent stability of the siding boards. FIG. 8 illustrates one example of such a situation wherein the longitudinal axial line C1 of the post 1 (2) is offset from the longitudinal axial line C2 of the fastening member 20 when the fastening member 20 is attached to the post 1 (2). However, as shown FIG. 8, it is still possible to screw the locking screw 35 for the fastening member 20 in a region close to the longitudinal axial line C1 of the post 1 (2), thus allowing the fastening member 20 to be stably attached to the post 1 (2).

Figure 10:
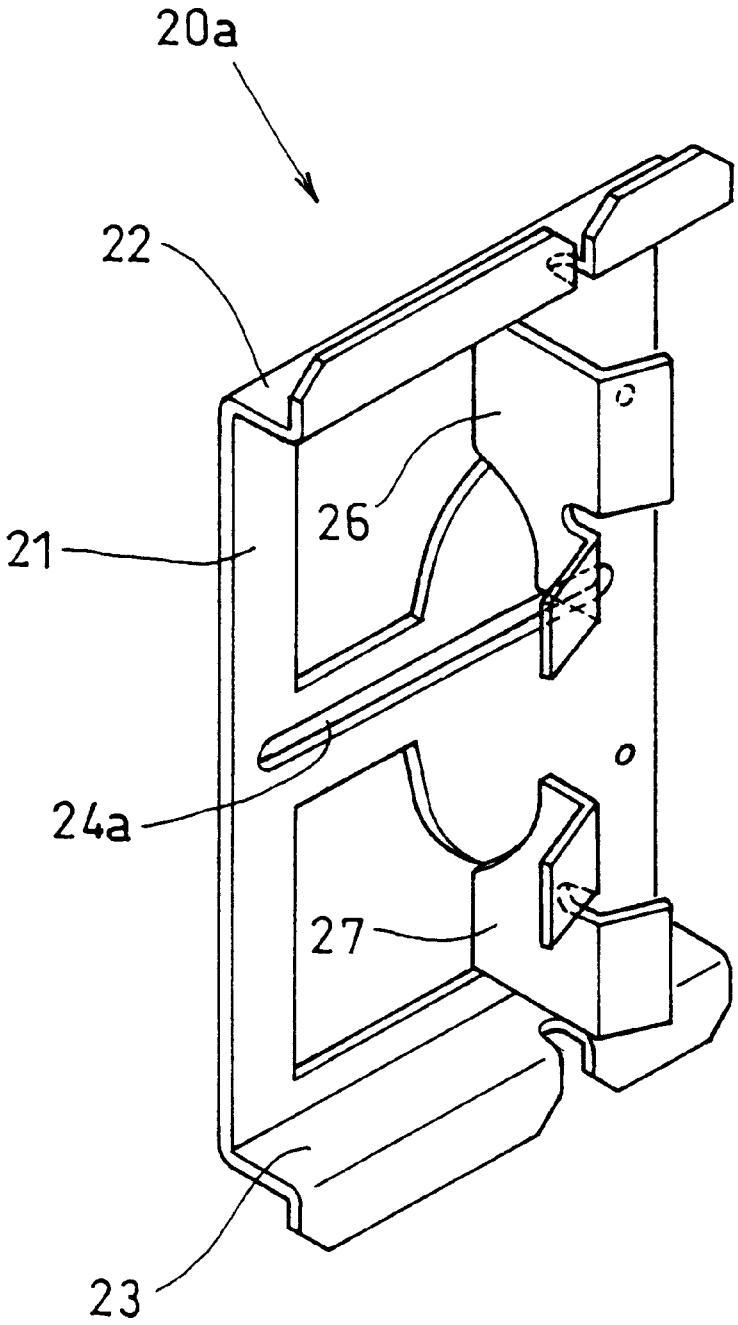
FIG. 10 is a perspective view illustrating further example of the fastening member for vertical board siding according to this invention.

FIG. 10 illustrates another example of the fastening member 20*a* which is especially effective in stabilizing the attachment of the fastening member. Namely, this fastening member 20*a* differs from the fastening member 20 shown in FIG. 1 in that the slot 24*a* is extended longer as compared with the slot 24 of the fastening member 20. As a result, the distance the fastening member 20*a* can be laterally shifted in relative to the post is increased, thereby making it possible to suitably cope with a large error in interval between the posts.

Figure 11:
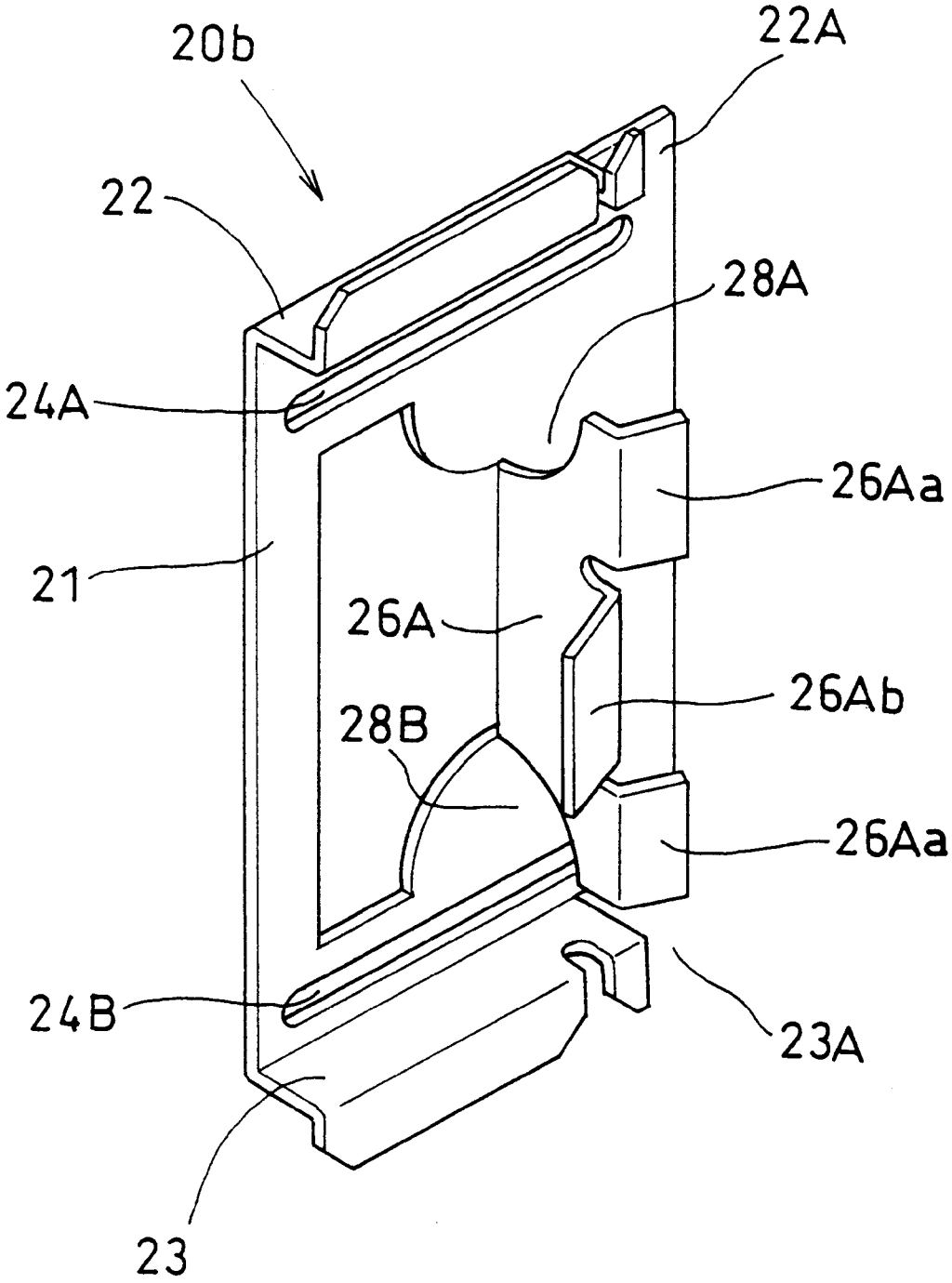
FIG. 11 is a perspective view illustrating a still another example of the fastening member for vertical board siding according to this invention.
Figure 12:
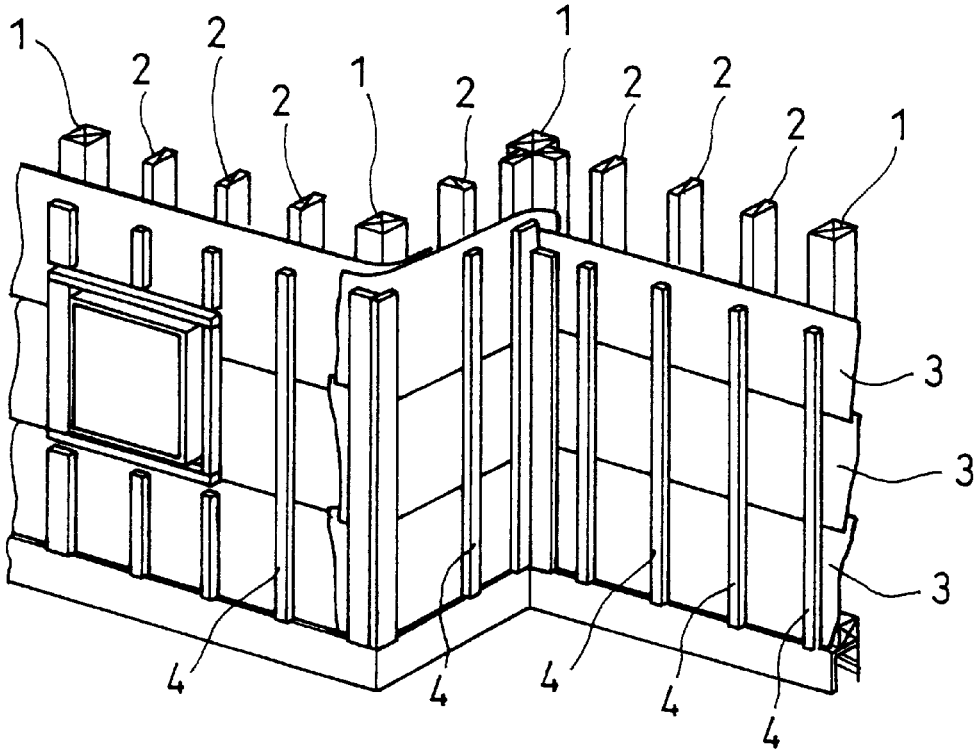
FIG. 12 is a perspective view illustrating a conventional backing framework for a horizontal board siding.
Figure 13:
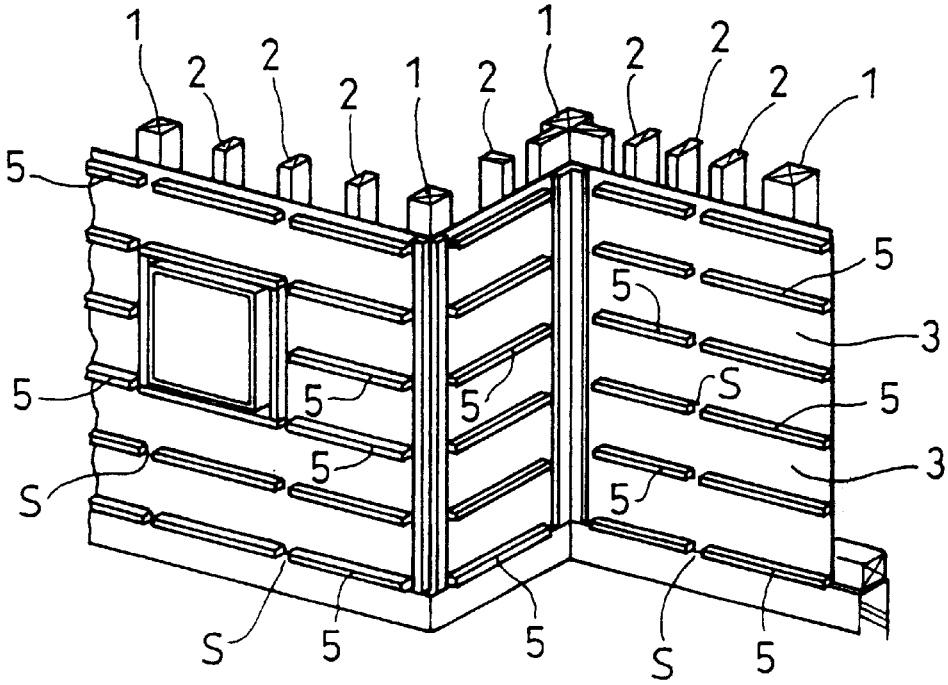
FIG. 13 is a perspective view illustrating a conventional backing framework for a vertical board siding.
Figure 14:
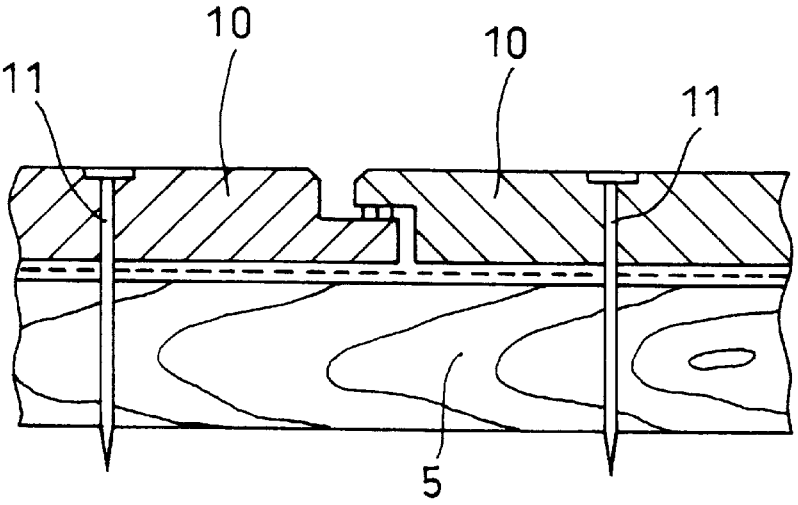
FIG. 14 is a cross-sectional view illustrating a fastened state of siding boards in the conventional vertical board siding.
Figure 15:
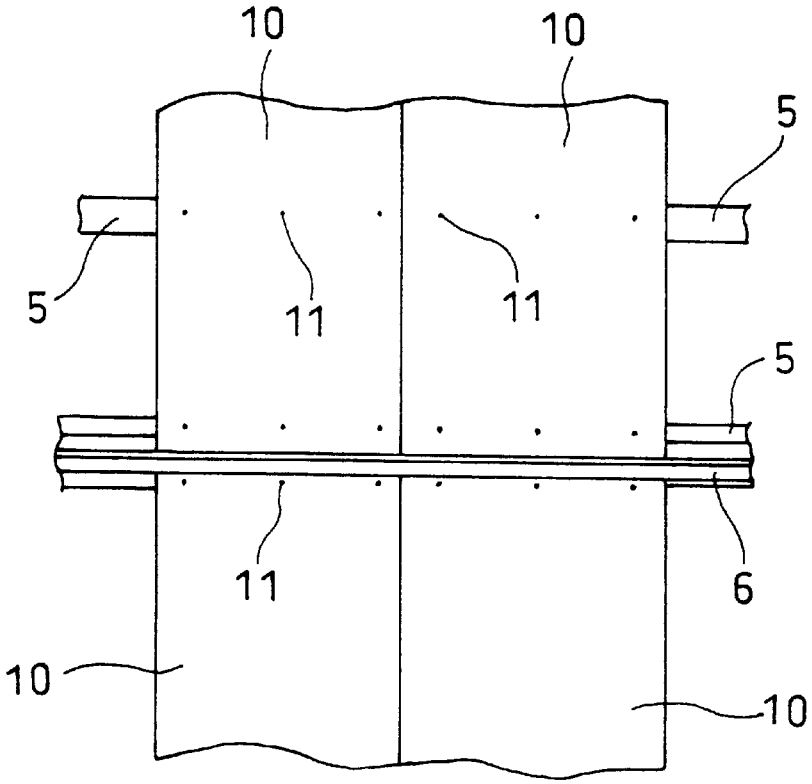
FIG. 15 is a front view illustrating a fastened state of the siding boards in the conventional vertical board siding.

FIG. 11 illustrates still another example of the fastening member 20*b* wherein the third upright portion is not partitioned into the upper third upright portion 26 and the lower third upright portion 27 as in the case of the previous examples, i.e. these upper and lower third upright portions 26 and 27 are integrated into a single third upright portion 26A. Three locking strips 26A*a*, 26A*b* and 26A*a* are formed on the upper edges of the third upright portion 26A. Additionally, a slot 24A is formed between the third upright portion 26A and the first upright portion 22, while another slot 24B is formed between the third upright portion 26A and the second upright portion 23.

Moreover, the third upright portion 26A is provided at the upper brim portion thereof (a portion facing the first upright portion 22) with a cutout 28A, and at the lower brim portion thereof (a portion facing the second upright portion 23) with a cutout 28B. The first upright portion 22 as well as the second upright portion 23 are also provided at the one side region thereof with a cutout portion 22A and a cutout portion 23A, respectively. Since not only the slot 24A but also the slot 24B are separately provided as mentioned above, the degree of freedom in attaching the fastening member 26A to the framework can be increased, and at the same time, more stabilized attachment of the fastening member 26A can be realized, since the fastening member 26A can be finally clamped at two different points.

Although it is not depicted in the drawing, it is also possible, as another modification, to limit the number of the slot 24 to only one, which may be provided either at the upper portion or at the lower portion of the substrate 21 in the above embodiment depicted in FIG. 11. Further, although it is explained in the foregoing explanation that the third upright portion is formed by cutting and bending a portion of the substrate 21, the third upright portion may be formed separately from the substrate 21 and then fixed to the substrate 21 by means of welding.

According to this invention, it is possible to firmly fasten the siding boards in the vertical state to the building frame by simply attaching a plurality of fastening members to each of the adjacent posts along the longitudinal direction of each post, thereby making it possible to greatly simplify the board siding and at the same time, to enhance the aesthetic look of the resultant structure. Moreover, since the siding board is fastened in such a way that the vertical sides of the siding board are clamped at various locations, the wind pressure resistive strength can be prominently enhanced.

Further, it is possible according to this invention to secure a larger room space as compared with the conventional board siding where horizontal furring strips are employed.

What is claimed is:

1. A fastening member for vertical siding boards, comprising:

a flat substrate constituting a mounting surface to a building frame;

a first upright portion formed at an upper end portion of said flat substrate and extending in a lateral direction of said flat substrate;

a second upright portion formed at a lower end portion of said flat substrate and extending in the lateral direction of said flat substrate;

a third upright portion formed transverse said first and second upright portions;

a locking portion formed along a distal end of said third upright portion, said locking portion including first and second locking strips which are bent in substantially opposite lateral directions to each other and which are adapted to grip a side edge of a siding board; and a slot formed in said substrate and extending laterally from one side to another side of said substrate;

wherein the locking strips, the third upright portion and the first and second upright portions of the flat substrate together define spaces to receive the side edge of the siding board.

2. The fastening member according to claim 1, wherein said third upright portion is provided with a cutout facing said slot.

3. A method of installing vertical board siding by using posts located adjacent to each other, said method comprising the steps of:

attaching a plurality of first fastening members to a post along the longitudinal direction of the post;

provisionally attaching a plurality of second fastening members to an adjacent post along the longitudinal direction of the adjacent post by means of a plurality of clamping members each extending through a slot created in each of said second fastening members, and temporarily fixed to said adjacent post, thereby allowing said second fastening members to be moved in a lateral direction;

vertically placing a siding board between at least one of said first fastening members and at least one of said second fastening members;

moving in the lateral direction said at least one of said second fastening members to press an upright portion thereof onto a vertical side of said siding board, thus positioning said siding board;

firmly fixing one of said clamping members corresponding to said at least one of said second fastening members into said adjacent post thereby tightening said at least one of said second fastening members to said adjacent post; and repeating the aforementioned steps until the vertical board siding is installed;

wherein the step of firmly fixing is performed by inserting a fixing tool through a cutout, created in said upright portion and facing said slot, to engage and drive said clamping member into said adjacent post.

4. A vertical siding structure constructed using siding boards, said vertical siding structure further comprising a plurality of vertical posts located adjacent to each other; and a plurality of fastening members attached to the posts along the longitudinal direction of the posts, each fastening member having a flat substrate constituting a mounting surface to a building frame;

a first upright portion formed at an upper end portion of said flat substrate and extending in a lateral direction of said flat substrate;

a second upright portion formed at a lower end portion of said flat substrate and extending in the lateral direction of said flat substrate;

a third upright portion formed between said first and second upright portions;

a locking portion formed along a distal end of said third upright portion, said locking portion including first and second locking strips which are bent in substantially opposite lateral directions to each other and which are adapted to grip a side edge of one siding board; and a slot formed in said substrate and extending laterally from one side to another side of said substrate;

wherein both vertical sides of said siding boards are engaged with the locking strips formed along the distal end of said third upright portions of said fastening members.

5. The vertical siding structure of claim 4, wherein each of said fastening members further includes in said third upright portion a cutout facing said slot.

6. A fastening member for vertical siding boards, comprising:

a flat substrate constituting a mounting surface to a building frame;

a first upright portion formed at an upper end portion of said flat substrate and extending in a lateral direction of said flat substrate;

a second upright portion formed at a lower end portion of said flat substrate and extending in the lateral direction of said flat substrate;

a third upright portion formed centrally of said flat substrate and extending therefrom, and between said first and second upright portions;

a locking portion formed along a distal end of said third upright portion, said locking portion including first and second locking strips which are bent in substantially opposite lateral directions to each other and which are adapted to grip a side edge of one siding board; and a slot formed in said substrate and extending laterally from one side to another side of said substrate.

7. The fastening member according to claim 6, wherein said third upright portion extends substantially perpendicularly to said first upright portion.

8. A method of installing vertical board siding by using posts erected adjacent to each other, said method comprising the steps of:

a) providing a plurality of fastening members, each fastening member comprising a flat substrate constituting a mounting surface to a building frame;

a first upright portion formed at an upper end portion of said flat substrate and extending in a lateral direction of said flat substrate;

a second upright portion formed at a lower end portion of said flat substrate and extending in the lateral direction of said flat substrate;

a third upright portion formed centrally of said flat substrate and extending therefrom, and between said first and second upright portions a locking portion formed along a distal end of said third upright portion, said locking portion including first and second locking strips which are bent in substantially opposite lateral directions to each other and which are adapted to grip a side edge of one siding board; and a slot formed in said substrate and extending laterally from one side to another side of said substrate;

b) attaching a first set of said fastening members to a post along the longitudinal direction of the post;

c) provisionally attaching a second set of said fastening members to an adjacent post along the longitudinal direction of said adjacent post by means of clamping members, each clamping member extending through the slot created in each fastening member of the second set and temporarily fixed to said adjacent post, thereby allowing the fastening members of the second set to be moved laterally;

d) vertically placing a siding board between at least one fastening member of the first set and at least one fastening member of the second set;

e) moving said at least one fastening member of the second set laterally to press the third upright portion thereof onto a vertical side of said siding board, thus positioning said siding board;

f) firmly fixing one of said clamping members corresponding to said at least one fastening member of the second set into said adjacent post thereby tightening said at least one fastening member of the second set to said adjacent post; and g) repeating the aforementioned steps until the vertical board siding is installed.

* * * * *